United States Patent [19]

Cappel et al.

[11] 4,158,799

[45] Jun. 19, 1979

[54] SCREWING TOOL FOR PRINTING PRESSES

[75] Inventors: Bert Cappel; Alfred Dorn, both of Lammerspiel, Fed. Rep. of Germany

[73] Assignee: Roland Offsetmaschinenfabrik Faber & Schleicher AG., Fed. Rep. of Germany

[21] Appl. No.: 821,085

[22] Filed: Aug. 2, 1977

Related U.S. Application Data

[63] Continuation-in-part of Ser. No. 807,579, Jun. 17, 1977, abandoned.

[51] Int. Cl.[2] ..... G05G 5/00

[52] U.S. Cl. ..... 318/626; 318/603; 173/12; 81/52.4 B

[58] Field of Search ..... 318/602, 603, 626; 173/1, 12, 18, 19, 6; 81/52.4 B

[56] References Cited

U.S. PATENT DOCUMENTS

| | | | |
|---|---|---|---|
| 3,939,920 | 2/1976 | Hardman et al. | 173/1 |
| 4,081,037 | 3/1978 | Jonsson | 173/1 |
| 4,083,270 | 4/1978 | Tomkinson | 81/52.4 R |

*Primary Examiner*—B. Dobeck

*Attorney, Agent, or Firm*—Leydig, Voit, Osann, Mayer & Holt, Ltd.

[57] ABSTRACT

A control system for a reversible screwing tool for tightening and loosening screws in a printing press or the like which includes a pair of angularly spaced pick-up devices coupled to the shaft of the tool for generating respective series of impulses. Monostable pulse generators are coupled to the respective pick-up devices, the generator coupled to the pick-up device in leading position, for counterclockwise rotation, being set to produce an output pulse which is substantially wider than that produced by the generator which is connected to the pick-up device in trailing position so that during counterclockwise rotation the output pulses from the generators timingly overlap one another. The generators feed into the input terminals of an AND gate which is, in turn, connected to a counter which counts the pulses resulting from counterclockwise rotation of the shaft. A relay interposed between the source and the tool automatically turns off the tool when a predetermined count is achieved thereby insuring that the screw is not excessively unscrewed from its tight condition. The relay is resettable in readiness for engagement of the succeeding screw. In the preferred embodiment of the invention the generator which is coupled to the pick-up device in leading position is responsive to the trailing edge of the received impulse while the generator connected to the pick-up device in trailing position is responsive to the leading edge of the pulse which it receives.

8 Claims, 6 Drawing Figures

ADJUSTABLE COUNTER
DISCONNECT RELAY
TIMER FOR AUTOMATIC RESET
PULSE GEN.
PULSE GEN.
SOURCE
DRIVE
B Side
A Side
FIG. 3b (CW)
FIG. 3c (CCW SLOW)
FIG. 3a (CCW)
A
B
C
D
E

SCREWING TOOL FOR PRINTING PRESSES

This is a continuation-in-part of application Ser. No. 807,579 filed June 17, 1977 now abandoned.

Power driven hand tools have been widely used for tightening of a screw with predetermined torque and for loosening the screw with percussive action followed by unscrewing at a high rotary speed.

In the operation of a printing press, screws, and nuts as well, must be repeatedly tightened and loosened. In installing a set of printing plates for example the screws which hold the plate clamping bars are screwed tight by a power tool which is subsequently used, with reverse rotation, for loosening the screws for changing of the plates.

It is an object of the invention to provide a control system for a reversible screwing tool which includes provision for automatic turn-off after the drive shaft undergoes a predetermined number of revolutions in the counterclockwise direction, the predetermined rotation being sufficiently limited to insure that the screw is only partially unscrewed from its tight condition. As a result, each screw will be loosened, and unscrewed, an amount sufficient to free the engaged plate clamping bar while still keeping the screw head below the periphery of the plate cylinder. Thus it is an object to provide a screwing tool for use on a printing press which is incapable of unscrewing a clamping screw to the extent that the head of the screw might, if inadvertently left untightened, damage the blanket and form rollers. It is a related object to provide a tool and control system therefor which is capable of unscrewing a series of clamping screws to a precise and safe degree in quick succession thereby permitting changing of a set of plates in the shortest possible time without exercise of particular care or attention.

It is another object of the invention to provide a control system for a screwing tool which is capable of use with a wide variety of tools either electrically or penumatically driven and either of the direct drive or impact type. It is a more specific object, in such a system, to provide means for disabling the count during the period that the screw is being initially twisted loose and for enabling the count during the time that the screw is actually being unscrewed, thereby making the device particularly well suited for use with certain tools having an impact or percussion feature.

It is a general object of the invention to provide a control system for a screwing tool which is not only reliable and easy to use but which is economical and capable of use with tools available on the commercial market, requiring only a minor modification of the tool structure.

Other objects and advantages of the invention will become apparent upon reading the attached detailed description in connection with the drawings in which.

Figure 2A:
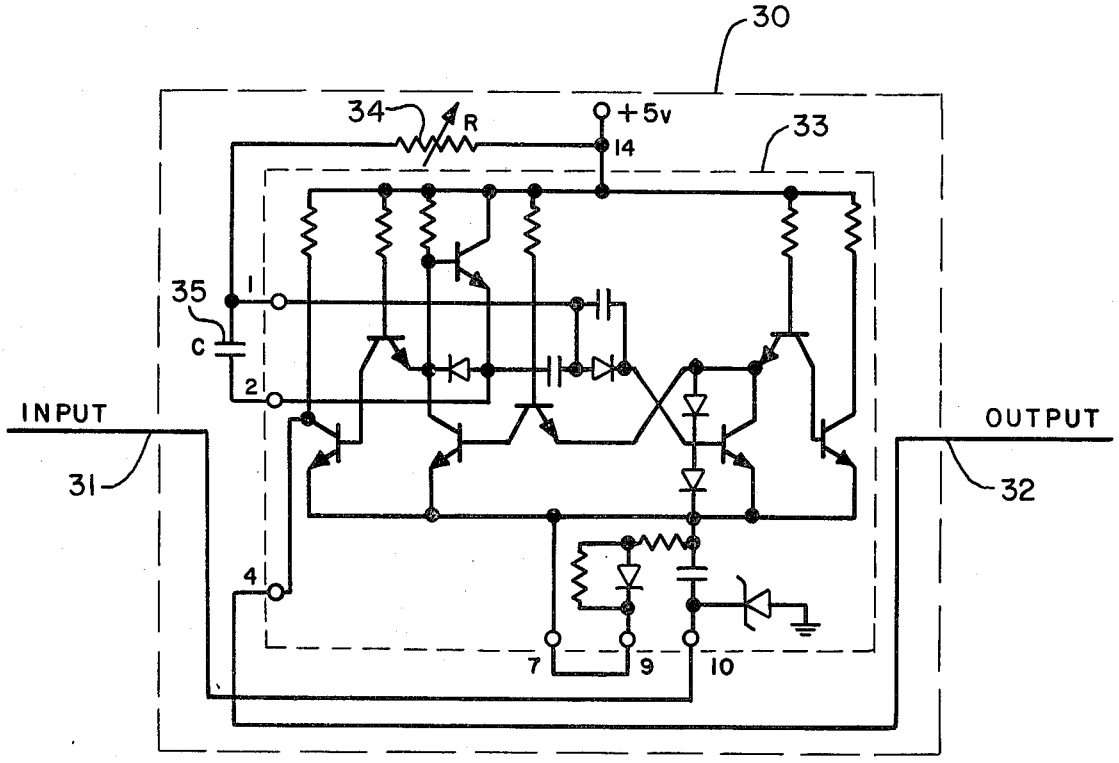
FIG. 2 shows the control circuitry in the form of a block diagram taken partly looking along line 2—2 in FIG. 1.
Figure 2:
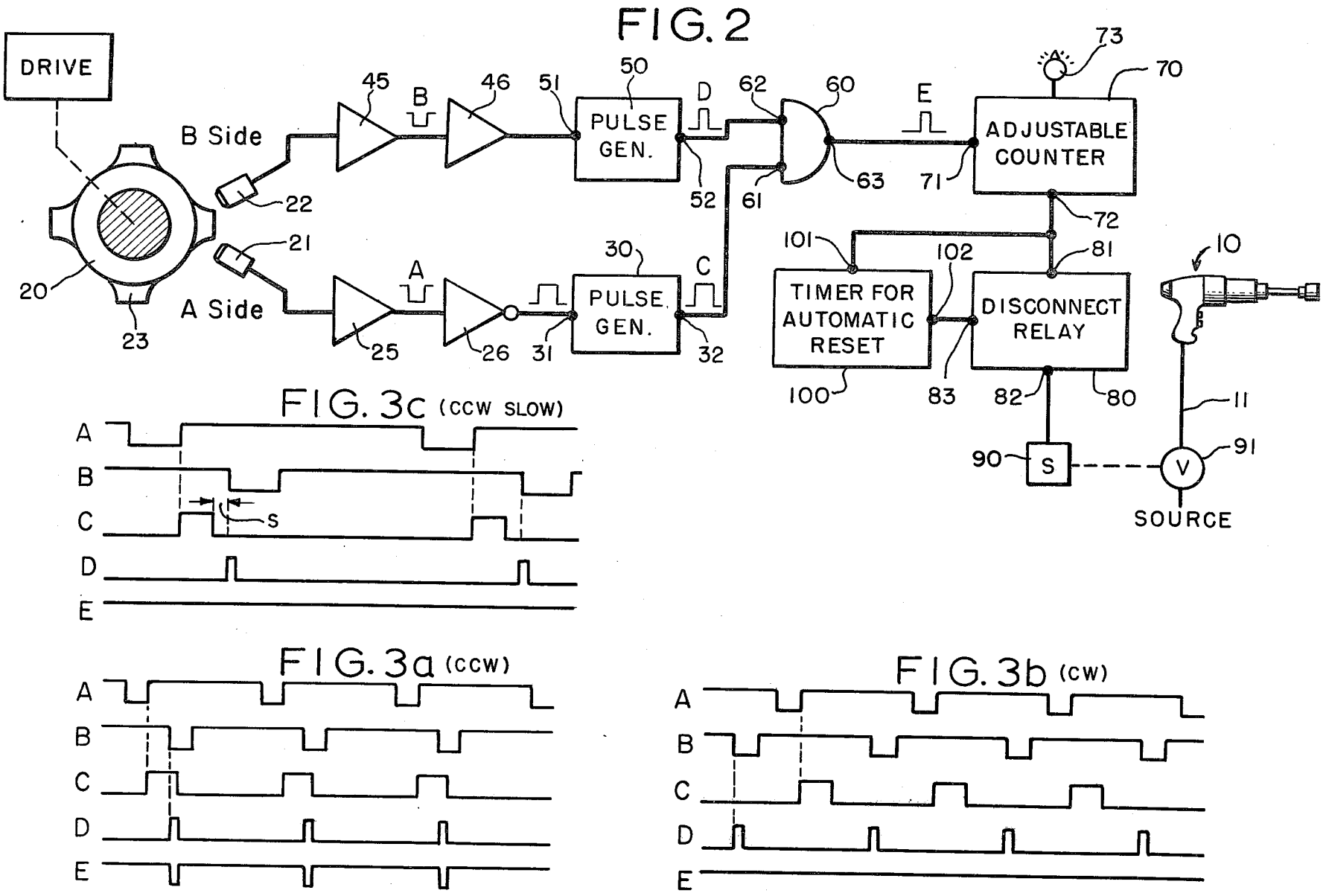

FIG. 2*a* illustrates the circuitry included in one of the blocks of FIG. 2;

FIG. 3*a* is a diagram showing the phasing of the signals in FIG. 2 in a typical unscrewing cycle;

FIG. 3*b* shows the signals in FIG. 2 during a typical tightening cycle;

FIG. 3*c* is a view similar to FIG. 3*a* but showing disablement of the count during the period that the screw is being initially twisted loose under conditions of slow speed.

While the invention has been described in connection with a preferred embodiment, it will be understood that we do not intend to be limited to the particular embodiment shown but intend, on the contrary, to cover the various alternative and equivalent constructions and circuitry included within the spirit and scope of the appended claims.

Figure 1:
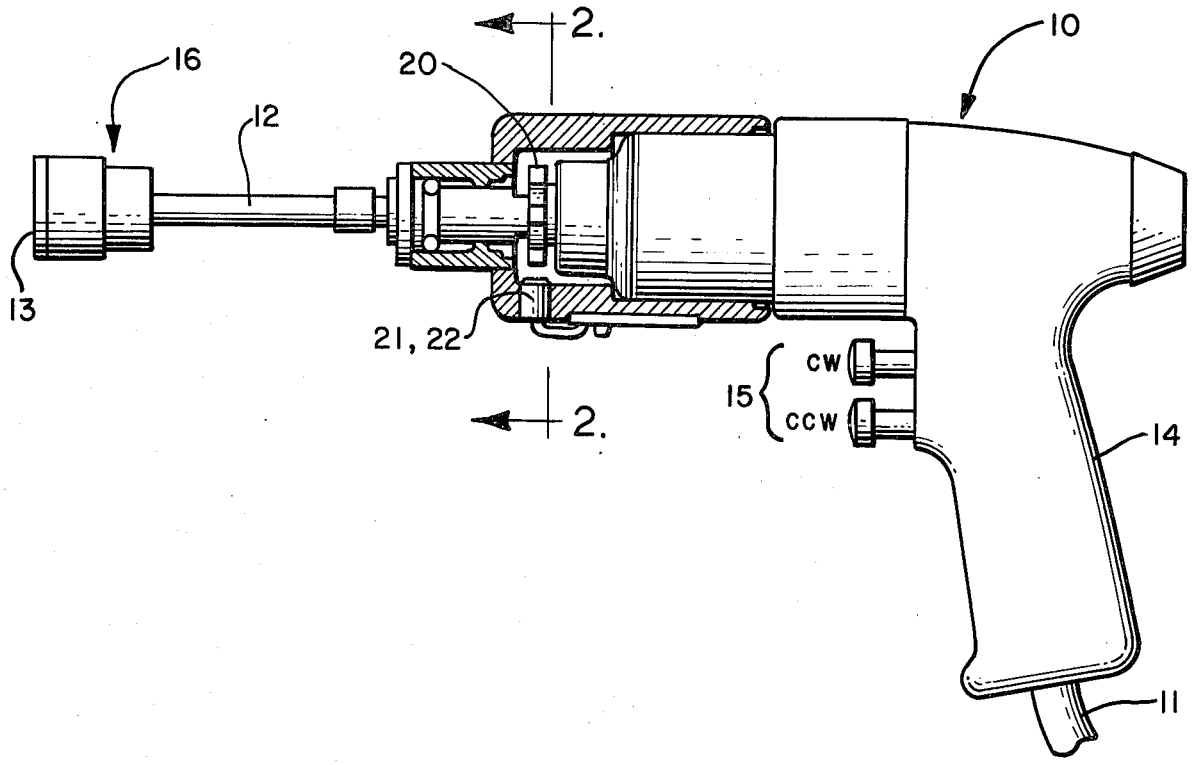
FIG. 1 shows a typical screwing tool to which the invention is applicable.

Turning now to FIG. 1 there is shown a screwing tool 10 which may either be of the pneumatic or electric type having a supply line 11 and an output shaft 12 carrying, at its end, a fitting 13. The body of the tool has a hand grip 14 providing a conveniently located set of controls 15 for clockwise and counterclockwise rotation. The controls are shown in the form of alternatively energizeable triggers, but it will be understood that a single trigger may be employed in conjunction with a direction selector switch, as may be commercially available.

In the normal operation of the tool torque is applied to the screw in the clockwise direction for screwing it tight to a preselected torque level. Removal is obtained by rotation in the opposite direction, with impact or percussive means, not shown but indicated generally at 16, providing a high initial twisting force.

In accordance with the present invention a pick-up device coupled to the shaft of the tool is provided for generating a series of pulses in accordance with rotation of the shaft in the counterclockwise direction with means for shutting off the tool after a predetermined count has been achieved thereby to insure that the screw is only partly unscrewed from its tight condition. More particularly in accordance with the invention a pair of angularly spaced pick-up devices are provided in the tool, one of which is in leading position during counterclockwise rotation, the pick-up devices being connected to monostable pulse generators. The generator which is coupled to the pick-up device in leading position is set to produce an output pulse which is substantially wider than that produced by the remaining generator so that during counterclockwise rotation the output pulses from the generators timingly overlap one another. An AND gate connected to the generators is responsive to the condition of overlap, the AND gate feeding a counter which effectively counts the counterclockwise revolutions of the drive shaft. The counter is used to control a relay interposed between the tool and its source for de-energizing the tool when the predetermined count is reached, the relay having provision for resetting in readiness for engagement of a succeeding screw.

Mounted within the tool for rotation with the drive shaft 12 is a star wheel 20 with cooperating magnetic pick-up devices 21, 22 which are angularly spaced from one another. The star wheel has magnetic arms or rays which sweep the vicinity of the pick-up devices, the pick-up device 21 being in "leading" position, and the device 22 being in "trailing" position during counterclockwise rotation of the star wheel. The pick-up devices will be understood, in the present instance, to be in the form of small magnetic pick-up coils but it will be apparent to one skilled in the art as the discussion proceeds that other equivalent types of pick-up devices may be used with equal advantage.

The pick-up device 20 is connected to a preamplifier 25 which feeds an amplifier 26 (which is connected as an inverter for reasons to be described) and which in turn is connected to a monostable pulse generator 30 having an input terminal 31 and an output terminal 32. The function of the pulse generator 30 is to receive an amplified impulse from the pick-up device 21 and to produce therefrom a well defined square wave pulse of predetermined amplitude and duration, or length. While monostable pulse generators are per se well known in the art, reference may be made to FIG. *2a* which shows a typical circuit. For convenience and economy the circuit may largely consist of an integrated circuit 33, a typical circuit for such usage, capable of being triggered by a negative-going voltage, is identified as Model DCL8162 Monostable Multivibrator manufactured by Signetics Corporation of Sunnyvale, California, U.S.A. For the purpose of adjusting the length of the resulting output pulse an RC circuit is used consisting of an adjustable rheostat 34 and capacitor 35.

In the upper leg of the circuit, the pick-up device 22 is connected to a preamplifier 45 which feeds an amplifier 46 which in turn supplies a monostable pulse generator 50 having terminals 51, 52 and which may employ the same circuit as that shown in FIG. *2a*.

The pulse generators are connected to an AND gate 60 having input terminals 61, 62 and an output terminal 63, the purpose of the AND gate being to produce an output pulse whenever pulses are simultaneously applied to the input terminals, that is, whenever the pulses applied to the input terminals are in timingly overlapped relation.

The pulses from the AND gate are fed to an adjustable counter 70 having an input terminal 71 and an output terminal 72 and of the type, well known in the market, which produces an output signal when a predetermined count has been achieved, the count being adjustable by a control 73. The counter is preferably of the type which automatically resets itself incident to producing an output signal.

The counter signal is fed to a disconnect relay 80 having an input 81, an output 82 and a reset terminal 83, the relay being of the normally closed type providing drop-out on receipt of an input signal. The relay is connected to a solenoid 90 which controls a valve 91 interposed in the supply line 11 between the source and the tool, assuming the tool is of the pneumatic type. Where the tool is electrically operated, the output circuit of the relay may be directly interposed in the electric supply line.

For the purpose of resetting the relay a timer 100 is provided having an input terminal 101 and an output terminal 120. The timer, of a type commercially available, is so constructed that when an input signal is received at the input terminal an output signal occurs at the output terminal a predetermined time interval thereafter for the purpose of resetting the relay to its normally closed condition. The time interval is sufficient to enable the operator to release the trigger and remove the tool from the screw in readiness for engagement of a succeeding screw.

In carrying out the present invention the monostable pulse generators 30, 50 are differentially adjusted, by appropriate setting of the resistor 34 therein, so that the pulse produced by the generator 30, which is connected to the pick-up 21, which is in leading position for counterclockwise rotation, is substantially longer than the pulse produced by the generator 50 in the trailing leg of the circuit. Moreover, in carrying out the invention in its preferred form the generator 30 is made responsive to the trailing edge of the impulse produced by the pick-up 21 whereas the generator 50 is connected to be responsive to the leading edge of the pulse which it receives. Selective response to the trailing edge by the generator 30 may be obtained by connecting the amplifier 26, which feeds it, as an inverter.

A typical cycle, achieving automatic de-energization of the tool upon a predetermined number of rotations of the shaft in a counterclockwise direction is as follows: Referring to FIG. *3a*, counterclockwise rotation of the star wheel produces a series of impulses from the "leading" pick-up device 21 as indicated at A. A similar series of impulses are produced by the pick-up device 22 as indicated at B, the impulses A being of leading phase. Such impulses, fed to the pulse generators 30, 50 produce output pulses therefrom shown at C and D, which output pulses are fed to the AND gate 60. In accordance with the invention, the generator output pulses from the generator 30, triggered by the pick-up device 21 in "leading" position (during counterclockwise rotation) are artificially lengthened by appropriate adjustment of the rheostat 34 so that, during counterclockwise rotation, the pulses C and D are fed to the AND gate 60 in timingly overlapped relation resulting in creation of output pulses E at the output of the AND gate.

Such gate output pulses are applied to the counter 70 which produces an output signal when a predetermined low count has been achieved, the output signal causing drop-out of the disconnect relay 80 and the opening of the valve 91 which supplies the tool, thereby turning off the tool outside of the operator's control after the screw has been loosened but before it has been excessively unscrewed. There is no limit to the "lowness" of the count; a count even as low as 1 may be utilized as a limiting condition where only a very slight amount of unscrewing is desired.

When the tool turns off, the operator releases the control 15 and moves the tool to the next screw in the series. The timer 100 resets the relay 80 within a short time interval so that the operator can manually re-energize the tool for unscrewing of the next screw in the series.

Thus, employing the present invention, the tool can be moved quickly from one screw to the next, with the tool being manually turned on at each screw but automatically turned off, outside of the operator's control, when the screw has been loosened, that is, unscrewed, to just the right degree for plate replacement purposes. This insures that the screw, in its unscrewed state, is still below the profile of the plate so that, if a press operator should inadvertently fail to retighten one of the screws, such screw will not damage the form rollers or blanket cylinder.

By causing the pulse generator 30 to respond to the trailing edge of an input pulse and the generator 50 to respond to the leading edge it will be apparent, in FIG. *3a*, that only a limited amount of widening of pulses C is effective to produce overlap for a given angular spacing of the pick-up devices 21, 22.

Referring next to FIG. *3b*, it will be observed that the circuitry is effectively disabled during clockwise rotation of the tool, that is, during inward screwing of the screws to tight condition. Under such circumstances the pick-up device 22 occupies the "leading" position and the pick-up device 21 occupies the relatively "trailing"

position so that the phase relationship of the pulses A and B are reversed. This causes a spreading apart of the output pulses from the generators 30, 50 resulting in lack of timed overlap so that pulses are not applied simultaneously to the AND gate, thereby avoiding creation of pulses E and effectively disabling the counter 70 and relay 80.

However, in accordance with one of the more detailed aspects of the present invention, means are provided for counting revolutions in the counterclockwise direction only when the tool is rotated at normal unscrewing speed. This feature is useful in certain types of impact tools in which rotation of the shaft of the tool, to which the star wheel is connected, results in successive impacts being applied to the screw, at a slow shaft speed, for initially twisting the screw loose and prior to the tool's achieving normal unscrewing speed. The effective disablement of the counter at slow clockwise speed may be understood by comparing FIG. *3c* with FIG. *3a* previously discussed. In FIG. *3a*, it will be recalled, alinement of the C and D pulses resulting from the pick-ups 21, 22, respectively, resulted in counting pulses E. However, at slow initial twisting speed the pulses A and B from the pick-ups are expanded on a time scale so that the resulting generator pulses C and D, instead of being aligned, are separated, in time, by an amount S so that the AND gate 60 is non-responsive. This enables utilization of the initial tool rotations for the purpose of impact "starting" of the screw head without including such rotations in the actual count. However, it should be noted that where the control system is employed with a direct drive tool, that is, a tool in which the motor is directly connected to the screw fitting, there is no loss of count as a practical matter since the screw head, once started, comes up quickly to normal tool speed. In any event loss of count by reason of low tool speed may be optionally prevented simply by adjusting the resistor 34, in the generator 30, to produce a somewhat more elongated output pulse.

While the invention has been described in connection with a preferred embodiment it will be apparent that the invention in its broader aspects includes means coupled to the shaft of the tool for generating a distinctive series of pulses (pulses A and B in FIGS. *3a*, *3b*, respectively) depending upon whether the shaft is turning in the clockwise or counterclockwise direction, with a counter being provided having means (here the generators and AND gate) for making the counter selectively responsive to the series of pulses corresponding to counterclockwise rotation.

While the invention preferably utilizes a commercial form of counter capable of making an actual count of the impulses from the AND gate, it will be understood that the term "counter" as used herein is used in the broad sense of an integrating device. Thus it will be apparent to one skilled in the art that the counter 70 may, if desired, and in its simplest aspect, be in the form of a capacitor across which voltage is successively built up by addition of pulses E to a point of triggering operation of the disconnect relay 80, without departing from the present invention.

Also while it is preferred to employ a commercial form of resettable normally closed relay, it will be understood that the term relay is not limited to a device of the magnetic type and solid-state relay circuitry may be readily used.

The term "trigger" has been used in reference to the manipulated control on the tool itself, but it will be understood that the manipulated control need not be of trigger shape or in trigger position to utilize the present invention.

The invention has been particularly discussed in connection with operation of the screws on the clamping bars of a plate cylinder for changing of the plates, but it will be understood that the invention has other uses in the operation and adjustment of a press including the tightening and loosening of screws on the blanket cylinder when changing the blanket, the opening and closing of an ink fountain and the operation of the threaded adjusting means controlling the pressure between the plate and blanket cylinders.

While the term "direct drive" has been contrasted with a drive of the impact type, it will be understood that both refer to tools in which the star wheel or equivalent rotation signalling device is directly connected to the fitting which engages the screw. The term "pulse generator" as used herein will be understood to include any device capable of producing a well defined pulse at the output upon being triggered by a pulse received by the input.

What we claim is:

1. In a control system for a screwing tool having a source of power with trigger means on the tool for selectively producing rotation in opposite directions for tightening and loosening screws in a printing press or the like, the combination comprising a pair of angularly spaced pick-up devices coupled to the shaft of the tool for generating respective series of impulses, one of the pick-up devices being in leading position to produce impulses of leading phase during counterclockwise rotation while the other is in trailing position, monostable pulse generators coupled to the respective pick-up devices, the generator which is coupled to the pick-up device in leading position being set to produce an output pulse which is substantially wider than that produced by the generator which is connected to the pick-up device in trailing position so that during counterclockwise rotation the output pulses from the generators timingly overlap one another, an AND gate having its input terminals connected to the pulse generators and having an output terminal, means including a counter connected to the output terminal of the gate for counting the pulses resulting from counterclockwise rotation of the shaft and for producing a counter output signal upon reaching of a predetermined count, means including a relay having its input connected to the counter and responsive to the output signal therefrom and having its output interposed between the source and the tool for turning off the tool when the predetermined count is reached, the predetermined count being sufficiently low to insure that the screw is only partially unscrewed from its tight condition, and means for resetting the relay in readiness for engagement of a succeeding screw.

2. In a control system for a screwing tool having a source of power with trigger means on the tool for selectively producing rotation in opposite directions for tightening and loosening screws in a printing press or the like, the combination comprising means including a pick-up device coupled to the shaft of the tool for generating a series of pulses in accordance with rotation of the shaft in the counterclockwise direction, means including a counter for counting the pulses and for producing a counter output signal upon reaching of a predetermined count, means including a relay having its input connected to the counter and responsive to the output signal therefrom and having its output interposed between the source and the tool for turning off the tool when the predetermined count is reached, the predetermined count being sufficiently low to insure that the screw is only partly unscrewed from its tight condition, and means for disabling the counter upon rotation of the shaft in the clockwise direction so that the screw may subsequently be turned tight regardless of the amount it has been unscrewed.

3. In a control system for a screwing tool having a source of power with trigger means on the tool for selectively producing rotation in opposite directions for tightening and loosening screws in a printing press or the like, the combination comprising means including a pick-up device coupled to the shaft of the tool for generating a series of pulses in accordance with rotation of the shaft in the counterclockwise direction, means including a counter for counting the pulses and for producing a counter output signal upon reaching of a predetermined count, means including a relay having its input connected to the counter and responsive to the output signal therefrom and having its output interposed between the source and the tool for turning off the tool when the predetermined count is reached, the predetermined count being sufficiently low to insure that the screw is only partly unscrewed from its tight condition, and means having a timer for resetting the relay automatically after a time delay sufficient to enable the operator to release the trigger and remove the tool from the screw.

4. In a control system for a screwing tool having a source of power with trigger means on the tool for selectively producing rotation in opposite directions for tightening and loosening screws in a printing press or the like, the combination comprising means including a pick-up device coupled to the shaft of the tool for generating a series of pulses in accordance with rotation of the shaft in the counterclockwise direction, means including a counter for counting the pulses and for producing a counter output signal upon reaching of a predetermined count, means including a relay having its input connected to the counter and responsive to the output signal therefrom and having its output interposed between the source and the tool for turning off the tool when the predetermined count is reached, the predetermined count being sufficiently low to insure that the screw is only partly unscrewed from its tight condition, and means for disabling the count during the period that the screw is being initially twisted loose and for enabling the count during the time that the screw is actually being unscrewed.

5. In a control system for a screwing tool having a source of power with trigger means on the tool for selectively producing rotation in opposite directions for tightening and loosening screws in a printing press or the like, the combination comprising means including a pick-up device coupled to the shaft of the tool for generating distinctive series of pulses in accordance with rotation of the shaft in the clockwise and counterclockwise directions, respectively, means including a counter having means selectively responsive to the series of pulses corresponding to counterclockwise rotation for counting the pulses and for producing a counter output signal upon reaching of a predetermined count, means including a relay having its input connected to the counter and responsive to the output signal therefrom and having its output interposed between the source and the tool for turning off the tool when the predetermined count is reached, the predetermined count being sufficiently low to insure that the screw is only partly unscrewed from its tight condition.

6. In a control system for a screwing tool having a source of power with trigger means on the tool for selectively producing rotation in opposite directions for tightening and loosening screws in a printing press or the like, the combination comprising means including a pair of angularly spaced pick-up devices cooperating with the shaft of the tool for generating individual series of pulses with corresponding pulses in the series being offset in phase, the pick-up devices being respectively leading or trailing depending upon the direction of shaft rotation, an AND gate having input terminals connected for response to the respective series of pulses and having an output terminal, a counter for counting the pulses and for producing a counter output signal upon reaching of a predetermined count, means including a relay having its input connected to the counter and responsive to the output signal therefrom and having its output interposed between the source and the tool for turning off the tool when a predetermined count is reached, the pulses originated at the leading pick-up during counterclockwise shaft rotation being sufficiently long so as to timingly overlap the pulses originated at the trailing pick-up so that the counter is activated only during counterclockwise rotation, the predetermined count being sufficiently low as to insure that the screw is only partly unscrewed from its tight condition.

7. In a control system for a screwing tool having a source of power with trigger means on the tool for selectively producing rotation in opposite directions for tightening and loosening screws in a printing press or the like, the combination comprising a pair of angularly spaced pick-up devices coupled to the shaft of the tool for generating respective series of impulses, one of the pick-up devices being in leading position to produce impulses of leading phase during counterclockwise rotation while the other is in trailing position, monostable pulse generators coupled to the respective pick-up devices, the generator which is coupled to the pick-up device in leading position being responsive to the trailing edge of the impulse therefrom and the generator which is connected to the pick-up device in trailing position being responsive to the leading edge of the impulse therefrom with the output pulses of the generators being of such relative width that during counterclockwise rotation the output pulses timingly overlap one another, an AND gate having its input terminals connected to the pulse generators and having an output terminal, means including a counter connected to the output terminal of the gate for counting the pulses resulting from counterclockwise rotation of the shaft and for producing a counter output signal upon reaching of a predetermined count, means including a relay having its input connected to the counter and responsive to the output signal therefrom and having its output interposed between the source and the tool for turning off the tool when the predetermined count is reached, the predetermined count being sufficiently low to insure that the screw is only partially unscrewed form its tight condition, and means for resetting the relay after a timed interval.

8. In a control system for a screwing tool having a source of power with trigger means on the tool for selectively producing rotation in opposite directions for tightening and loosening screws in a printing press or the like, the combination comprising a pair of angularly spaced pick-up devices coupled to the shaft of the tool for generating respective series of impulses, one of the pick-up devices being in leading position to produce impulses of leading phase during counterclockwise rotation while the other is in trailing position, monostable pulse generators coupled to the respective pick-up devices, the generator which is coupled to the pick-up device in leading position being responsive to the trailing edge of the pulse therefrom and the generator which is connected to the pick-up device in trailing position being responsive to the leading edge of the pulse therefrom so that during counterclockwise rotation the output pulses from the generators timingly overlap one another, the generator connected to the pick-up device in leading position having means for adjustably augmenting the width of the output pulse therefrom to insure overlap, an AND gate having its input terminals connected to the pulse generators and having an output terminal, means including a counter connected to the output terminal of the gate for counting the pulses resulting from counterclockwise rotation of the shaft and for producing a counter output signal upon reaching of a predetermined count, means including a relay having its input connected to the counter and responsive to the output signal therefrom and having its output interposed between the source and the tool for turning off the tool when the predetermined count is reached, the predetermined count being sufficiently low to insure that the screw is only partially unscrewed from its tight condition.

* * * * *